United States Patent [19]

Kildal

[11] Patent Number: 4,963,878

[45] Date of Patent: Oct. 16, 1990

[54] REFLECTOR ANTENNA WITH A SELF-SUPPORTED FEED

[76] Inventor: Per-Simon Kildal, 2A Torplassen, 8018 Saupstad, Norway

[21] Appl. No.: 151,517

[22] PCT Filed: Jun. 3, 1987

[86] PCT No.: PCT/NO87/00044

§ 371 Date: Mar. 7, 1988

§ 102(e) Date: Mar. 7, 1988

[87] PCT Pub. No.: WO87/07771

PCT Pub. Date: Dec. 17, 1987

[30] Foreign Application Priority Data

Jun. 3, 1986 [NO] Norway ..... 861292

[51] Int. Cl.[5] ..... H01Q 19/19

[52] U.S. Cl. ..... 343/781 P; 343/786; 343/840

[58] Field of Search ..... 343/840, 837, 786, 781 R, 343/781 P, 781 CA, 782

[56] References Cited

U.S. PATENT DOCUMENTS

| | | | |
|---|---|---|---|
| 2,698,901 | 1/1955 | Wilkes | 343/781 P |
| 2,829,366 | 4/1958 | Armstrong et al. | 343/781 P |
| 3,055,004 | 9/1962 | Cutler | 343/781 |
| 3,162,858 | 12/1964 | Cutler | 343/840 |
| 3,983,560 | 9/1976 | MacDougall | 343/781 CA |
| 4,188,632 | 2/1980 | Knox | 343/781 P |
| 4,673,945 | 6/1987 | Syrigos | 343/840 |
| 4,673,947 | 6/1987 | Newham | 343/785 |

*Primary Examiner*—Michael C. Wimer

*Attorney, Agent, or Firm*—James E. Pittenger

[57] ABSTRACT

A reflector antenna with a dish-shaped main reflector (10), and a self-supporting feed (11) for the transmission or reception of polarized electromagnetic waves. The feed (11) consists of a tube (12) which is attached to the middle of the main reflector (10) and is terminated by a subreflector (13) so that an intermediate space (14) is formed between the subreflector and the end of the tube. The part of the tube that is nearest the intermediate space (14) contains a cylindrical waveguide (15), or is the waveguide itself, and has an approximately circular or quadradic cross-section. Externally, the intermediate space (14) is bonded by a circular, cylindrical surface (16) with the same diameter as the outer diameter of the tube (12) this being called the aperture surface. The surface of the subreflector (13) which is located just outside the surface of the aperture (16) has circular corrugations (17), or other means of creating a reactive, anisotropic surface impedance, to ensure that the electromagnetic waves are propagated along the surface regardless of whether the electrical field is tangential to the surface or is normally on it. The part of the subreflector (13) that is located within the aperture surface (16) is shaped as a central conical element (18) with reflecting characteristics and which is inclined towards the tube (12).

13 Claims, 3 Drawing Sheets

REFLECTOR ANTENNA WITH A SELF-SUPPORTED FEED

FIELD OF THE INVENTION

The invention consists of a reflector antenna with a self-supported feed for the transmission or reception of polarized electromagnetic waves. The antenna is principally intended for the reception of TV signals from sattelites, however it can be used as a radio link, and as a ground station for sattelite communications.

BACKGROUND OF THE INVENTION

These types of reflector antennas are chiefly used because they are straightforward and inexpensive to manufacture. They also provide greater antenna efficiency and lower side lobes in the radiaton pattern than is the case when the feed element has to be supported by diagonal struts. The drawback with the latter configuration is that the main reflector becomes blocked. A self-supported feed is also easely accessible from the back of the reflector, thus is frequently selected when it is best to locate the transmitter and/or the receiver there. This also reduces the loss that occurs when the waves have to be led in a cable along one at the support struts.

A. Chlavin, "A New Antenna Feed Having Equal E and H-Plane Patterns", IRE Trans. Antennas Propagat., Vol. AP-2, pp. 113–119, Jul. 1954, describes a reflector antenna with a self-supporting feed. However since this antenna uses a waveguide with a rectanguler cross-section, it can only transmit or receive waves with one particular linear polarization.

C. C-Cutler, "Parabolic-antenna design for microwaves", Proc. IRE, Vol. 35, pp. 1284–1294, Nov. 1947, describes a dual polarized reflector antenna with two variants of a self-supporting feed, called the "ring focus" and the "waveguide cup" feeds respectively. A circular waveguide is used in these two feeds with a reflecting object in front of the waveguide opening, this reflector being respectively shaped like a flat disc and a cup. Both of these feeds unfortunately produce high cross-polarization within the main lobe the radiation pattern.

SUMMARY OF THE INVENTION

The main purpose of the present invention is to design a reflector antenna which has dual polarization with low cross-polarization within the main lobe of the radiation pattern. Dual polarization means that the antenna is capable of receiving or transmitting two waves with orthogonal linear or circular polarization simultaneously. The waveguide must have an almost circular or quadratic cross-section.

This objective can be achieved by a design which is in accordance with the charaterizing part of Claim 1. Further details about the invention are given in Claims 2–10.

The surface of the subreflector is treated so that the electromagnetic waves are reflected from and propagate along the surface in approximately the same way regardless of whether the electric field is normally on the surface or is tangential to it. Furthermore, the design of the other geometries of the feed ensures that the cross-polarization remains low within the main lobe of the radiaton pattern.

It should be mentioned that a dual polarized reflector antenna with a self-supporting feed is already known from among other sources such as P. Newham, "The Search for an Efficient Splashplate Feed", Proceedings of the Third International Conference on Antennas and Propagation (ICAP 83), IEE Conference Publication No. 219, pp. 348–352, Apr. 1983, and in previous publications by the same author. In this design the subreflector has a smooth surface. However, it is also possible to obtain low cross-polarization when the subreflector is positioned at a distance from the waveguide aperture so that the waves are prevented from becoming radial and cannot propagate along the surface of the subreflector. This avoids the polarization-dependent reflection coefficient for radial waves found in the smooth subreflector. The present invention, on the other hand, has conceived of an antenna where this distance is so small that some of the waves are able to propagate along the surface of the subreflector. Low cross-polarization is then only ensured by a surface where the reflection coefficient for radial waves is independent of the polarization.

The main advantage of the present invention over P. Newham's solution is that the diameter of the subreflector can be reduced so that the blockage in the center of the main reflector is also smaller.

It should also be noted that a dual polarized antenna that radiates around a cylinder is described by A. W. Love, "Scale Model Development of a High Efficency Dual Polarized Line Feed for the Arecibo Spherical Reflector", IEEE Trans. Antennas Propagat., Vol. AP-21, pp. 628–639, Sept. 1973. This antenna is, however, a linear array antenna consisting of numerous elements, which feed a main spherical reflector antenna. Further, this antenna has no subreflector.

Mention should also be made of a dual polarized element which radiates around a smooth conductor cylinder. This is reported by P. S. Kildal in "Study of Element Patterns and Excitations of the Line Feed of the Spherical Reflector Antenna in Arecibo". IEEE Trans. Antennas Propagat., Vol. AP-34, pp. 197–207, Feb. 1986. Section 11 of this paper provides a theoretical analysis of such an element. Once again there is no subreflector, and the element does not feed a main reflector. One result of this theoretical work is in fact the present invention.

In U.S. Pat. No. 3,162,858 a dual polarized reflector antenna is described with a self-supporting feed element which mainly consists of a radial waveguide shaped as two plane surfaces or two coaxial conical surfaces with a common apex. In the present invention there are no such radial waveguides; a subreflector is employed instead.

Since the tube in the present invention is cylindrical rather than conical, the subreflector and the outside of the tube are unable to form radial waveguides. Consequently, the waves are not propagated in the form of radial wave modes in this area, as is the case in the U.S. Patent mentioned above.

The U.S. Patent describes an antenna with a ring-shaped focus (the equivalent to the phase center of the feed element) in the opening or aperture of the radial waveguide, and there is no subreflector outside this phase-center. In the invention however, the feed element ring-shaped phase center is close to the cylindrically-shaped aperture surface between the end of the tube and the middle of the subreflector. Consequently, in the invention the subreflector is mainly outside the phase center.

In the U.S. Patent both walls in the radial waveguide have circular corrugations which are approximately 0.25λ wavelengths deep. These corrugations give the walls an anisotropic surface impedance which results in the radial waves being propagated so that they are independent of the polarization in the waveguide. In the present invention. It is first and foremost only the subreflector which is supplied with such an anisotropic, reactive surface impedance. Using the investigations derived from the formulae in the paper already mentioned in IEEE Trans. Antennas Propagat., Vol. AP-34, Feb. 1986, it has been found that in most cases it is unnecessary to treat the outside of the tube with such a surface impedance. This consequently makes the invention cheaper to manufacture than the existing antenna where two surfaces have to be corrugated.

There is no reason why the outside of the tube described in the present invention cannot be given an anisotropic reactive surface impedance, this may even be advantageous since in some applications particularly strict demands regarding cross-polarization may be required.

The present invention is based on a theoretical model concerning the way which radiation is released from a circumterencial slot in a cylinderical tube (cf. the paper mentioned in IEEE Trans. Antennas and Propagat., Vol. AP-34, Feb. 1986).

The bandwidth problem in the invention is solved by the central part of the subreflector being designed as a cone that is aimed in the direction of the main reflector. This cone reflects the incidence waves from the waveguide in a radial direction so that only small amplitude waves are reflected back to the waveguide. This minimizes return loss. At the same time a correct balance is achieved between the axial and the circumferential E-fields over the cylindrical aperture, thus ensuring low cross-polarization. This can be achieved over a relative bandwidth of about 10%.

All mechanical dimensions between the middle of the subreflector and the end of the tube are critical, nevertheless there are a good number of dimension combinations which provide satisfactory results.

BRIEF DESCRIPTION OF DRAWINGS

The invention will be explained in more detail by making reference to the drawings, where.

DETAILED DESCRIPTION OF THE INVENTION

Figure 1:
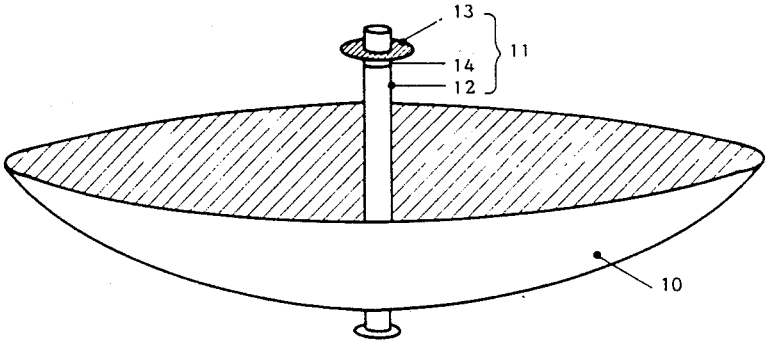
FIG. 1 illustrates an example of a reflector antenna with a self-supporting feed.

The antenna in FIG. 1 consists of a dish-shaped main reflector 10. In the middle of the reflector there is a self-supporting tubular feed element 11. This consists of a cylindrical tube 12, and a subreflector 13. The tube and the subreflector are separated by a gap 14 which is bounded on the outside by a circular, cylindrical aperture surface 16 which will henceforth be termed the aperture surface or the aperture.

Figure 2:
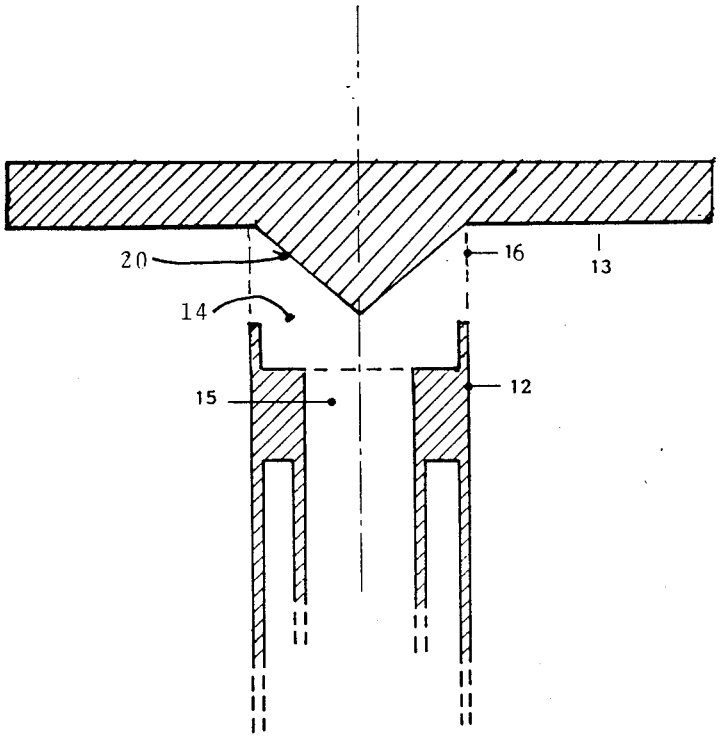
FIG. 2 shows an axial cross-section through a feed designed in accordance with the invention.

FIG. 2 shows an axial section through the feed. The tube 12 contains a cylindrical waveguide 15 which preferably has a circular cross-section. The tube can also be such a waveguide itself. The waveguide is constructed to propagate the basic mode. This is the $TE_{11}$ mode when the internal cross-section is circular with smooth, conducting walls. The waveguide must have a larger diameter than 0,6 (approx.) wavelengths λ and be smaller than 1.2λ (approx.). The tube and the waveguide are mostly made of conducting materials. Though a smooth surface is shown, it could also be manufactured so that the surface impedance is anisotropic and reactive. The thickness of the walls measured between the inside of the waveguide and the outside of the tube is less than 1.0λ (approx.). The wall can also be extremely thin. FIG. 2 shows a case where the gap 14 extends slightly into the tube so that a circular waveguide is formed with a larger diameter than waveguide 15. The gap 14 can also have another design.

The subreflector is drawn as a plate with a conical element 20 in the middle. It can also be shaped otherwise. The part of the subreflector's surface that is located outside the aperture surface 16 is drawn to appear smooth, however in fact it is treated so that the surface impedance is anisotropic and reactive. This ensures that the electromagnetic waves are reflected from and propagate along the surface in approximately the same way regardless of whether the electric field is normally on the surface or is tangential to it. This is important to achieve low cross-polarization. The best results come from making the surface impedance so that there is only a minor amount of radiation in a radial direction along the subreflector both when the field is normally on the surface and when it is tangential to it. The diameter of the subreflector is always larger than the diameter of the tube, typical values are between 3λ and 6λ.

The aperture surface 16 is indicated in FIG. 2 by a broken line. The cross-section of the aperture 16 is under 1.0, λ preferably 0,5λ (approx.). In the same way the end of the waveguide 15 is marked by a broken line. There is a gap 14 between the aperture and the end of the waveguide, this is bounded by the subreflector and the tube. The gap 14 is drawn so that it appears to be filled be air. In practice they would be partly or totally filled with dielectric matter, or they could be partially sealed with metallic or dielectric rods or discs that are respectively located in a plane with the axis of symmetry. Though this is necessary to attach the subreflector to the tube, this is also a means of controlling the excitation of the two modes over the aperture 16 and hence the radiation characteristics.

Figure 3:
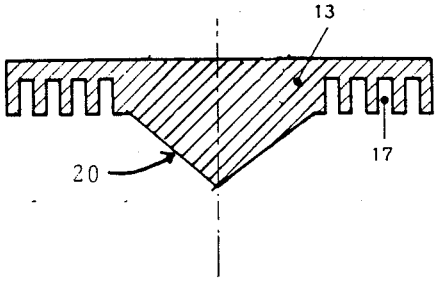
FIG. 3 shows an axial cross-section through a subreflector which has a corrugated surface.

FIG. 3 shows an axial cross-section of a subreflector 13 where the part that lies outside the aperture 16 has circular corrugations or grooves 17 in the surface. This grooves are about 0,25λ deep. This is one way of realizing the anisotropic and reactive surface impedance. The objective is as mentioned before to obtain as little radiation as possible in a radial direction along the subreflector both when the field is normally on the surface and also when it is tangential to it. This is important to obtain low cross-polarization. This objective can also be achieved by a surface having other characteristics.

Figure 4:
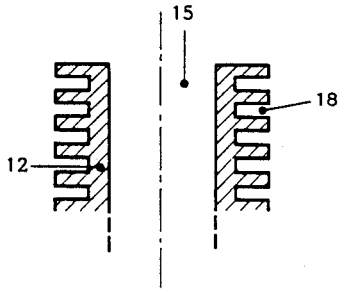
FIG. 4 shows an axial cross-section through a tube with circular corrugations on the surface.

FIG. 4 shows an axial cross-section of a tube 12 where there are circular corrugations 18 in the surface. These corrugations are about 0,25λ deep and produce an anisotropic, reactive surface impedance. The purpose is to obtain as little radiation as possible along the tube both when the field is orthogonal to the surface and when it is tangential to it. This can also be achieved by a surface with different characteristics.

Figure 5:
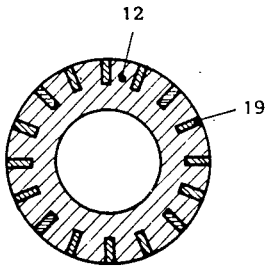
FIG. 5 shows a normal section on a tube with longitudinal corrugations on the surface.

FIG. 5 shows a cross-section of a tube 12 where the surface has longitudinal corrugations 19. These are filled with a dielectric having a relative permittivity of $\epsilon$. The depth of the corrugations $0{,}25\lambda/\sqrt{\epsilon-1}$. These corrugations provide an anistropic, reactive surface impedance. The objective is to produce powerful radiation along the tube both when the field is normally on the surface and when it is tangential to it. This can also be managed by using a surface having other characteristics.

Figure 6:
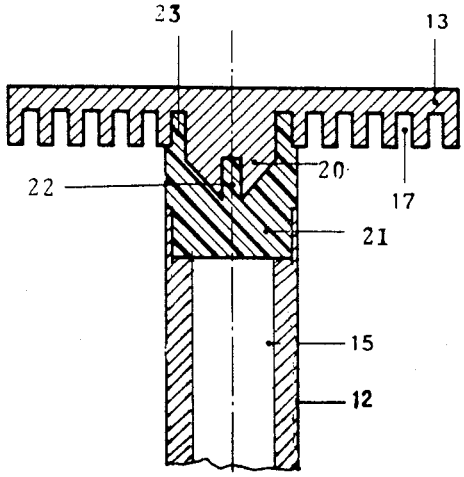
FIG. 6 shows an axial cross-section through a means of designing a feed element in accordance with the invention, and, FIG. 7 indicates which dimensions for the design in FIG. 6 must be trimmed and are critical.
Figure 7:
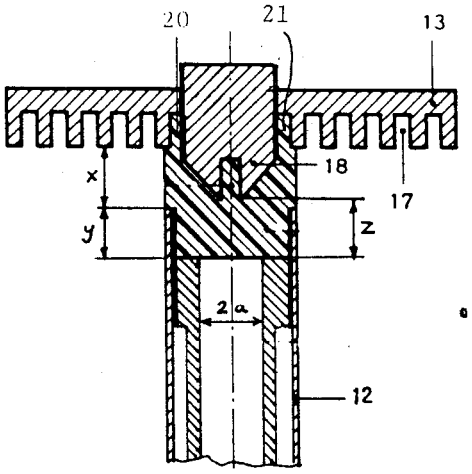

FIG. 6 shows a normal means of designing the feed element. The gap 14 is filled with a dielectric plug or element 21 which is glued or screwed into both the tube and the subreflector by means of an extra groove 23 inside the aperture surface or by means of a central outlet 22 in the conical part 20 of the subreflector 13. The part of the subreflector 13 which lies outside the aperture surface is plane and has circular corrugations. The dielectric plug 21 passes into the tube 12 and forms a cylindrical waveguide with a larger diameter than the waveguide 15. FIG. 7 also shows the design in FIG. 6. The critical dimensions which must be trimmed in the laboratory model are marked x, y, z and 2*a*. This can be done by making the concial element 20 so that it can be screwed into the subreflector. In addition, the waveguide 15 and the dielectric plug 21 are both to be made so that they can be screwed into the tube 12. The manner in which the design in FIG. 6 works for linear polarization is explained in the next paragraph. In the case circular polarization the design works in an equivalent way because the geometry has rotational symmetry. The manner of operation is explained for transmission, but is equivalent when receiving.

A wave in the $TE_{11}$ mode is propagated in the waveguide 15. This wave is coupled to two modes at the surface of the aperture 16. For one mode the electric fields are directed exclusively in the z-direction (z-mode), and for the other the fields are directed in the azimuth-direction transverse to the z-direction ($\phi$-mode). These two modes radiate out of the aperture 16, the z-mode principally in the E-plane and the $\phi$-mode chiefly in the H-plan. To get a rotationally-symmetrical radiation pattern with low cross-polarization, the radiation patterns in the E and H-planes must be similar in both amplitude and phase. The anisotropic and reactive surface impedance to the subreflector 13 is the reason why the z-mode radiates the same way in the E-plane as the $\phi$-mode radiates in the H-plane. At the same time the internal dimensions of the feed element are controlled so that the z-mode and the $\phi$-mode are excited by the correct amplitude and phase, relatively-speaking. The z-mode and the $\phi$-mode radiate differently along the tube. This can be improved by making the surface impedance along the tube anisotropic and reactive, as described previously. This is an extra cost and was not found to be necessery for the alternative in FIG. 6. The reactive and anisotropic surface impedance of the subreflector is realized by means of circular corrugations 17. These prevent the z-mode radiating strongly in a radial direction. The excition of the $\phi$-mode and the z-mode are controlled by varying the dimensions of x, y, z and 2*a* in FIG. 7. The best results are obtained if the external part of the tube forms a waveguide whith a larger diameter than the waveguide 15, enabling both the $TE_{11}$ and the $TM_{11}$ modes to be propagated here. The resulting radiation pattern from the feed antenna has low cross-polarization. Unfortunately there are considerable phase errors because the source of radiation, the aperture 16, is a long way from the axis. These phase errors can be compensated for by shaping the main reflector differently rather than as a parabolic surface. If the diameter of the tube is about $1\lambda$, the optimal reflector shape will deviate by up to 1.6 mm from the best fitted parabola. The resultant radiation characteristics of the whole antenna are excellent and have low cross-polarization.

FIG. 6 shows one design of the antenna, it should nevertheless be apparant from the claims that there are numerous other forms possible. Common for all is that the part of the subreflector's surface which is outside the aperture 16 has an anisotropic and reactive surface impedance. Other common features are that the geometries of the central part 20 of the subreflector 13 and the dielectric element 21 filling the gap 14 are designed so that the required modes are excited with the correct phase and amplitude.

This design makes particular allowance for how the modes radiate both along the tube and the surface of the subreflector. The ideal shape is when the radiation patterns from both modes are intergrated in an optimal manner so that the resultant pattern is in rotational symmetry and has low cross-polarization. Altering the shape of the gap 14 or filling this completely or partially with a dielectric, are two means of influencing the relative excitation of the modes.

The different elements that are illustrated in FIGS. 2 and 3 can be combined and modified in various ways. The tube 12 can be a polygonal or square cylinder. The subreflector can be manufactured of plastic with a metallic surface coating. The plug 21 in the gap 14 can be combined with the subreflector 13 in other ways than those shown, for instance just one of elements 22 or 23 are used. If only element 22 is used, the subreflector will not have a central outlet at its point 20. If only element 23 is used, the subreflector will not have any corrugations inside the aperture 16.

I claim:

1. In an antenna system, a reflector and a feed element for radiating and intercepting electromagnetic waves, comprising:

(a) a main reflector, and (b) a self-supported waveguide feed element located along the axis which passes through the center of said main reflector, said feed element including;

(1) a support-tube which has one end attached to the center of said main reflector and the other end located near the focal region of the reflector;

(2) a waveguide located inside said tube;

(3) a subreflector located outside the outer end of said tube and said waveguide, said subreflector having a diameter larger than said support-tube;

(4) a gap provided between said subreflector and the outer end of said tube, being externally bounded by an imaginary cylindrical aperture surface which has substantially the same diameter as the outer diameter of said tube;

(5) the part of said tube which is nearest to the gap having an outer surface which is mainly cylindrical with a circular cross-section; and (6) the part of the surface of said subreflector which lies outside said aperture surface is planar and has an anisotropic and reactive surface impedance, and the part of said subreflector which lies within said aperture surface is shaped as a converging element which has reflecting characteristics and which is inclined towards said tube.

2. The reflector antenna system as claimed in claim 1, wherein said main reflector is rotationally symmetrical and has a substantial parabolic shape when said tube has a diameter which is smaller than 1.0 wavelengths.

3. The reflector antenna system claimed in claim 1, wherein the anisotropic and reactive surface impedance of said subreflector is obtained by rotationally symmetrical grooves in an electrically conducting surface.

4. The reflector antenna system claimed in claim 1, wherein said tube has a reflecting outer surface with a substantially anisotropic and reactive surface impedance, said impedance being created by circumferential corrugations.

5. The reflector antenna system claimed in claim 11, wherein said converging element of the subreflector is integrated with the rest of the subreflector.

6. The reflector antenna system claimed in claim 11, wherein the gap between said tube and said subreflector is substantially filled with a dielectric element which is interlocked with said waveguide and said subreflector.

7. The reflector antenna system which is claimed in claim 1 wherein said waveguide has a section with a larger diameter near the outer end than that section thereof remaining in the tube.

8. The reflector antenna system which is claimed in claim 1 wherein the waveguide is formed by the inner surface of the support tube.

9. The reflector antenna system which is claimed in claim 1, wherein the surface impedance of said subreflector is obtained by symmetrical corrugation formed in an electrically conducting surface.

10. In an antenna system, a reflector and a feed element for radiating and intercepting electromagnetic waves, comprising:

(a) a main reflector; and (b) a self-supported waveguide feed element located along the axis which passes through the center of said main reflector, said feed element including, (1) a support-tube which has one end attached to the center of said main reflector and the other outer end located near the focal region of the reflector;

(2) a waveguide located inside said tube;

(3) a subreflector located outside the outer end of said tube and said waveguide;

(4) a gap provided between said subreflector and the outer end of said tube, and being externally bounded by an imaginary cylindrical aperture surface, which has substantially the same diameter as the outer diameter of said tube;

(5) a part of the surface of said subreflector which lies outside said aperture surface having an anisotropic and reactive impedance; and (6) said support tube having a reflecting outer surface with a substantially anisotropic and reactive surface impedance, said impedance being created by longitudinal corrugations filled with a dielectric material, wherein longitudinal refers to the length of the support-tube.

11. An antenna system, a reflector and a feed element for radiating and intercepting electromagnetic waves comprising:

(a) a main reflector; and (b) a self-supported waveguide feed element located along the axis which passes through the center of said main reflector, said feed element including:

(1) a support-tube which has one end attached to the center of said main reflector and the other outer end located near the focal region of the reflector;

(2) a waveguide located inside said tube;

(3) a subreflector located outside the outer end of said tube and said waveguide;

(4) a gap provided between said subreflector and the outer end of said tube, and being externally bounded by an imaginary cylindrical aperture surface, which has substantially the same diameter as the outer diameter of said tube;

(5) a part of the surface of said subreflector which lies outside said aperture surface having an anisotropic and reactive impedance; and (6) the part of said subreflector which lies within said aperture surface is shaped as a converging element which has reflecting characteristics and which is inclined toward said tube, said converging element of the subreflector is a separate element mounted in a central opening provided in the subreflector.

12. An antenna system, a reflector and a feed element for radiating and intercepting electromagnetic waves comprising:

(a) a main reflector; and (b) a self-supported waveguide feed element located along the axis which passes through the center of said main reflector, said feed element including:

(1) a support-tube which has one end attached to the center of said main reflector and the other outer end located near the focal region of the reflector;

(2) a waveguide located inside said tube;

(3) a subreflector located outside the outer end of said tube and said waveguide;

(4) a gap provided between said subreflector and the outer end of said tube, and being externally bounded by an imaginary cylindrical aperture surface, which has substantially the same diameter as the outer diameter of said tube;

(5) a part of the surface of said subreflector which lies outside said aperture surface having an anisotropic and reactive impedance;

(6) the part of said subreflector which lies within said aperture surface is shaped as a converging element which has reflecting characteristics and which is inclined towards said tube; and (7) the gap between said tube and said subreflector is substantially filled with a dielectric element which is interlocked with said waveguide and said subreflector, and said dielectric element has a central pin pointing towards and connected to a corresponding outlet in said converging element.

13. An antenna system, a reflector and a feed element for radiating and intercepting electromagnetic waves comprising:

(a) a main reflector; and (b) a self-supported waveguide feed element located along the axis which passes through the center of said main reflector, said feed element including:

(1) a support-tube which has one end attached to the center of said main reflector and the other outer end located near the focal region of the reflector;

(2) a waveguide located inside said tube;

(3) a subreflector located outside the outer end of said tube and said waveguide;

(4) a gap provided between said subreflector and the outer end of said tube, and being externally bounded by an imaginary cylindrical aperture surface, which has substantially the same diameter as the outer diameter of said tube;

(5) a part of the surface of said subreflector which lies outside said aperture surface having an anisotropic and reactive impedance;

(6) the part of said subreflector which lies within said aperture surface is shaped as a converging element which has reflecting characteristics and which is inclined towards said tube; and (7) the gap between said tube and said subreflector is substantially filled with a dielectric element which is interlocked with said waveguide and said refletor, and said dielectric element has a circular protrusion which is interlocked with a circular groove in said subreflector.

* * * * *